United States Patent [19]

Cavazza

[11] 4,244,467

[45] Jan. 13, 1981

[54] DEVICE FOR THE EXTEMPORANEOUS PREPARATION OF A SOLUTION UNDER STERILE CONDITIONS

[75] Inventor: Claudio Cavazza, Rome, Italy

[73] Assignee: Sigma-Tau Industrie Farmaceutiche Riunite S.p.A., Rome, Italy

[21] Appl. No.: 45,165

[22] Filed: Jun. 4, 1979

[30] Foreign Application Priority Data

Jun. 5, 1978 [IT] Italy ..... 49717 A/78

[51] Int. Cl.[3] ..... B65D 81/32; A61J 1/00

[52] U.S. Cl. ..... 206/222; 128/272.3; 215/6; 222/80

[58] Field of Search ..... 206/222; 215/6, DIG 3; 128/272, 272.2, 272.3, 214.2; 222/80, 207

[56] References Cited

U.S. PATENT DOCUMENTS

| | | | |
|---|---|---|---|
| Re. 29,656 | 6/1978 | Chittenden et al. | 128/272.2 |
| 2,580,836 | 1/1952 | Rausch | 128/272 |
| 3,050,061 | 8/1962 | Goyke | 128/272 |
| 3,325,059 | 6/1967 | Hein | 128/272 |
| 3,484,849 | 12/1969 | Huebner et al. | 128/273.3 |
| 3,857,423 | 12/1974 | Ronca, Jr. | 128/272 |
| 4,136,692 | 1/1979 | Goldowsky | 128/214.2 |

*Primary Examiner*—William T. Dixson, Jr.
*Attorney, Agent, or Firm*—Ladas & Parry

[57] ABSTRACT

A device for extemporaneously preparing under sterile conditions a solution and dispensing carefully dosed amounts of the solution, is disclosed, wherein the container for the solvent is sealingly closed by an upwardly recessed capsule provided with an axially-extending, substantially cylindrical body the outwardly projecting end whereof is shaped as a piercing tip and having therein two parallel, adjacent passages. The opposite outlets of one passage are offset to the corresponding outlets of the adjacent passage.

5 Claims, 4 Drawing Figures

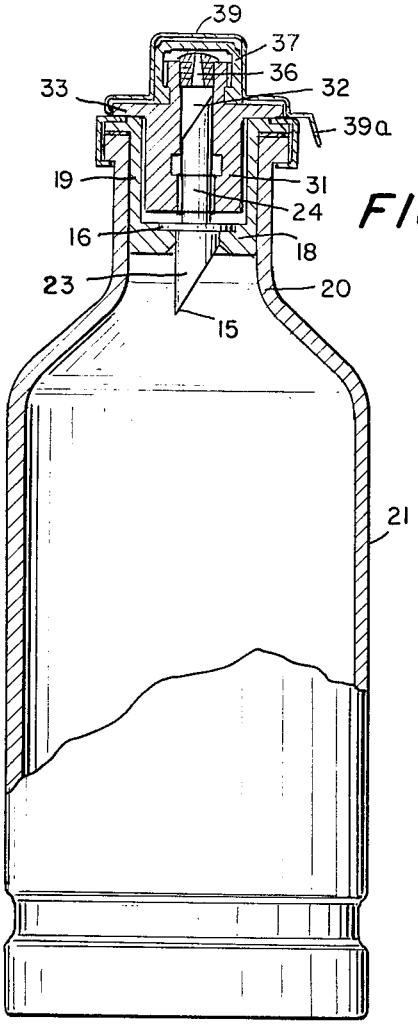
FIG. 1
FIG. 2
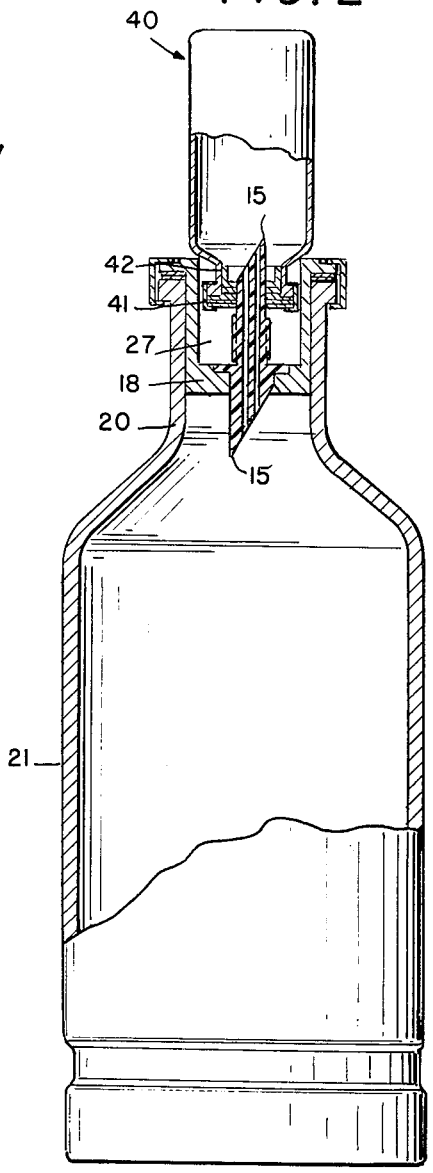
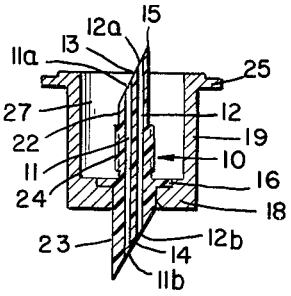
FIG. 3
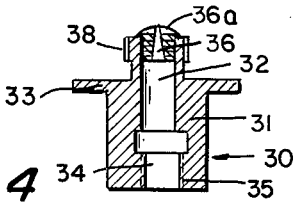
FIG. 4

DEVICE FOR THE EXTEMPORANEOUS PREPARATION OF A SOLUTION UNDER STERILE CONDITIONS

BACKGROUND OF THE INVENTION

1. Field of the Invention

The present invention relates to a device for mixing when required for use a liquid solvent with either a solid or liquid substance to be dissolved in the solvent, storing the solution thus obtained and dispensing under sterile conditions dosed amounts of the solution.

The present invention specifically tackles the problem of extemporaneously preparing and dispensing dosed amounts of pharmaceutical preparations which result from the extemporaneous mixing of a liquid solvent, which is kept in a first container, with a pharmaceutical substance or drug in powder or liquid form, kept in a second container, the pharmaceutical substance being mixed with or dissolved in the solvent when required for use.

2. Description of the Prior Art

There are known the difficulties which are often encountered when a liquid (e.g. a solvent) kept in a first sealed container is to be transferred under aseptical conditions into a second container which is also sealed, wherein a substance in solid or liquid form is placed. This situation occurs particularly in the pharmaceutical art wherein solutions, suitable for intravenous or oral administration are often extemporaneously prepared directly by the user by mixing a liquid solvent with a liquid or solid pharmacologically active agent, both the solvent and the active agent being stored separately in distinct containers up to the moment of mixture preparation.

Several devices have been disclosed, which are provided with pumping means for carrying out under aseptical conditions the transfer of a liquid solvent from a first sealed container into a second sealed container. These devices are costly and cumbersome and frequently do not afford satisfactory results.

It has been also proposed to keep one of the containers under vacuum, so that the vacuum causes, when the containers are connected to each other by means of a double-tipped, hollow needle inserted through the rubber plugs of both containers placed in superimposed relationship, the passage of the liquid solvent to occur from the container at atmospheric pressure into the container under vacuum. Also these arrangements have proved to be costly and cumbersome.

SUMMARY OF THE INVENTION

The object of the present invention is to eliminate the above-mentioned drawbacks by providing a device, particularly suitable for pharmaceutical applications, of simple and sturdy construction, which is extremely effective for transferring a liquid from a sealed container into a second container which is also sealingly closed.

It is another object of the present invention to provide a device suitable for transferring a liquid from a first container into a second container, under sterile conditions.

It is a further object of the present invention to provide a device of the previously mentioned type, which is also provided with a drop-counting device for dispensing carefully dosed amounts of the solution obtained by mixing extemporaneously the contents of the two containers.

It has now been found that the difficult problem of transferring under sterile conditions a liquid from a first, sealingly closed container into a second, sealed container arranged underneath said first container, can be effectively solved by a transfer device which puts the inner part of one of the containers into communication with the inner part of the second of said containers, said transfer device comprising two passages which run parallel in a side-by-side relationship, the adjacent outlets of said passages which open out in a same container being at different heights to each other. In other words, the adjacent outlets of the two passages in the inner part of the two superimposed containers must be correspondingly offset in such a way that the opposite outlets of one passage are at a lower (or higher) level with respect to the correspondingly adjacent outlets of the other passage.

DESCRIPTION OF THE PREFERRED EMBODIMENT

In the drawings:

FIG. 1 is a partly elevatinal and partly sectional view taken along the longitudinal axis of a container for a liquid solution, provided with a transfer device and a drop-dispensing device for dispensing said solution;

FIG. 2 is a view similar to that of FIG. 1, with the drop-dispensing device removed and a container for a pharmaceutical substance inserted in place for carrying out a transfer operations;

FIG. 3 is an axial sectional view taken along the diameter passing through the passages aligned in a side-by-side relationship of the transfer device; and FIG. 4 is an axial sectional view of the drop-dispensing device for dispensing said solution.

With specific reference to FIGS. 2 and 3, a transfer device in accordance with the present invention essentially comprises a substantially cylindrical body 10 having therein two longitudinally-extending, passing-through passages 11, 12 which are parallel to each other and to the axis of the body 10. The passages 11, 12 have their outlets 11*a*, 12*a* and 11*b*, 12*b* respectively which open out on the faces 13, 14 of body 10. The faces 13, 14 are parallel to each other and "cut" slanted to the body axis so as to form an acute angle therewith and provide a piercing tip 15 on each end of the body. As clearly shown in FIG. 3, the outlets 11*a*, 11*b*, 12*a* and 12*b* of the passages 11 and 12, because of the slanted "cut" of the faces 13, 14, open out at different heights.

The device 10 is carried by a peripherally-extending support 16 which is matingly received in a suitably shaped recess provided in the bottom 18 of a hollow capsule 19 engaged on the neck 20 of a container 21 for the liquid solvent, so that its upper portion 22 projects upwardly inside the hollow capsule 19, whereas its lower portion 23 projects downwardly in the inner part of the container 21.

In FIG. 4 a dispensing device 30 is shown. It comprises a cylindrical body 31 having therein an axial, cylindrical recess 32 and a peripherally-extending flange 33. The lower portion 34 of the recess 32 is internally threaded as in 35, whereas its upper portion is provided with a drop-dispensing passage 36. The axial recess 32 is suitably dimensioned so that it can receive the upper portion 22 of the body 10, whereas the thread 35 is such that it can screw on the outer, mating thread 24 of said upper portion. Furthermore, the flange 33 is so dimensioned as to abut against the upper flange 25 of the capsule 19 when the upper portion 22 is received in the recess 32 and threads 35, 24 are mutually engaged.

This arrangement is shown in FIG. 1, wherein there is also illustrated that the drop dispensing device 30 is provided with an internally threaded closing cap 37, screwed on the outer, mating thread 38 so as to sealingly close the passage 36 of the drop-meter 36*a*. Moreover, it can be noted that the assembly of the capsule 19, with its attendant transfer device 10, and the drop-meter 30 is sealed by a tearable cap 39 provided with a tear-off tongue 39*a*.

The composite device of the present invention also comprises a container 40 for the substance to be dissolved in the liquid solvent (e.g. a pharmaceutical substance). The container 40 is closed by a stopper in the form of a rubber plug 41 and has a neck so dimensioned that it can be received in the recess 27 of the capsule 19 for closing the container 20 when the drop-dispensing device 30 has been removed from the capsule.

In operation, when mixing is required, under sterile conditions, of the liquid solvent in the container 21 with the pharmaceutical substance (in liquid or solid, e.g. powder, form), in the container 40, one shall have to tear off both the tearable cap 39 and a similar cap (not shown) on the container 40, in order to expose the rubber plug 41.

Then, the drop-counting device 30 will be unscrewed and removed from the capsule 19, so as to expose the upper portion of the device 10.

The container 40 will be then overturned and its neck fitted into the recess 27 of the capsule 19 so that the piercing tip 15 pierces the plug 41, thus causing the upwardly projecting member 22 to penetrate into the container 40 (as shown in FIG. 2).

By overturning the whole assembly shown in FIG. 2, the liquid solvent stored in the container 21 (which is now located above the container 40) will pass into container 40 and the attendant mixing of the substance in this latter container with the solvent in container 21 will then occur.

When the container 40 is sufficiently filled with the liquid solvent of container 21, the user will once again overturn the assembly consisting of the superimposed containers (thus bringing it back to the position shown in FIG. 2). Consequently, the solution in container 40 will now pass into the container 21.

At this point the container 40 will be disposed of by the user and the drop-counting device 30 will be screwed into its position.

As concerned the theory of the operation of this transfer device 10, it is believed that because of the offset position of the two outlets 11*a*, 12*a* of the two passages, there is a different hydrostatic pressure which "triggers" the flow of the solvent, due to its gravity, from the container 21 to container 40.

The flow thus achieved continues very steady, until all the solvent has passed into the container 40.

The above disclosures will show that this invention permits all the foregoing objects to be achieved.

What is claimed is:

1. Apparatus for mixing and dispensing two substances comprising in combination a first container for sealingly containing a first substance, said first container having a neck defining a discharge opening and being sealable by a stopper, a second container for sealingly containing a second substance, said second container having a neck defining a discharge opening, a recessed plug having a base and upstanding side walls seated in said neck of the second container, said plug recess being open outwardly with respect to said second container and dimensioned sealingly to receive the neck of the first container, and an elongated transfer spout having a first end projecting into the second container and a second end extending substantially concentrically through the recess in said plug to enter the first container through said stopper, said transfer spout having a portion intermediate said first and second ends sealingly retained in said base of the recessed plug and being provided with two substantially parallel passages extending longitudinally therethrough.

2. Apparatus as claimed in claim 1, wherein the first and second ends of the transfer spout are bevelled whereby the respective ends of the substantially parallel passages open into the bevelled ends at different longitudinal locations.

3. Apparatus as claimed in claim 2, wherein the bevelled second end of the transfer spout provides a piercing tip.

4. Apparatus as claimed in claim 1, further including a drop dispensing device selectively seatable around the transfer spout and within the plug recess.

5. Apparatus as claimed in claim 4, wherein the drop dispensing device has an axial bore threaded at least part way along its length and wherein mating threads are provided around the external surface of the transfer spout.

* * * * *